US007207660B2

(12) United States Patent
Yamamoto et al.

(10) Patent No.: US 7,207,660 B2
(45) Date of Patent: Apr. 24, 2007

(54) ELECTROSTATIC INK JET HEAD FIXING A POSITION OF AN EDGE PORTION OF A MENISCUS OF INK

(75) Inventors: Ryoichi Yamamoto, Kanagawa (JP); Hideyuki Koguchi, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 181 days.

(21) Appl. No.: 10/934,702

(22) Filed: Sep. 7, 2004

(65) Prior Publication Data

US 2005/0179737 A1 Aug. 18, 2005

(30) Foreign Application Priority Data

Sep. 8, 2003 (JP) ..... 2003-315525

(51) Int. Cl.
*B41J 2/06* (2006.01)

(52) U.S. Cl. ..... 347/55; 347/54

(58) Field of Classification Search ..... 347/17, 347/18, 55, 111, 123, 127, 128, 54; 399/273, 399/290, 293, 244, 295
See application file for complete search history.

(56) References Cited

U.S. PATENT DOCUMENTS 6,158,844 A * 12/2000 Murakami et al. ..... 347/55

FOREIGN PATENT DOCUMENTS

JP 10-138494 A 5/1998
JP 10-230608 A 9/1998

* cited by examiner

*Primary Examiner*—Juanita D. Stephens
(74) *Attorney, Agent, or Firm*—Sughrue Mion, PLLC

(57) ABSTRACT

An electrostatic ink jet head has a head substrate, an insulating substrate having at least one through hole, an ink guide, ink supply means, a control electrode, and meniscus control means. An ink passage is formed between the head substrate and the insulating substrate. The meniscus control means controls fixing of an edge portion of an ink meniscus formed in proximity to the through hole or within the through hole. With the meniscus control means, it becomes possible to maintain the position and shape of the ink meniscus with stability, thereby allowing ejection and flying of liquid droplets, such as ink droplets, with stability and formation of an image of high quality on a liquid droplets reception member such as a recording medium.

10 Claims, 3 Drawing Sheets

ELECTROSTATIC INK JET HEAD FIXING A POSITION OF AN EDGE PORTION OF A MENISCUS OF INK

BACKGROUND OF THE INVENTION

The present invention relates to an electrostatic ink jet head that is used in an ink jet recording apparatus and causes liquid droplets containing dispersed particles to fly for image recording, and more particularly to an electrostatic ink jet head that allows ejection and flying of liquid droplets with stability.

Conventionally, an electrostatic ink jet recording system has been known which causes ejection of ink containing charged fine particle components by utilizing an electrostatic force generated through application of a predetermined voltage to each control electrode of an ink jet head based on image data, thereby recording an image corresponding to the image data on a recording medium. Various ink jet apparatuses using this electrostatic ink jet recording system are proposed (see JP 10-230608 A and JP 10-138494 A, for instance).

FIG. 3 is a schematic cross-sectional view schematically showing an ink jet head of a conventional ink jet recording apparatus disclosed in JP 10-230608 A.

As shown in FIG. 3, an ink jet head 100 has an insulating substrate 102 and a head substrate 104 which are arranged so as to oppose each other. A substrate through hole 102*a* is formed in the insulating substrate 102, and a control electrode 110 is provided around the substrate through hole 102*a*. Also, an ink guide 106 is provided at approximately the center of the substrate through hole 102*a* so as to stand on the head substrate 104. This ink guide 106 has a tip portion protruding from the substrate through hole 102*a* and includes an ink guide groove 108 formed by notching the ink guide 106 by a predetermined width along the center line of the ink guide 106.

Also, an ink reservoir 114 is formed between the insulating substrate 102 and the head substrate 104, and a signal voltage source 112 that supplies a signal voltage corresponding to an image that should be recorded is connected to the control electrode 110.

Further, a counter electrode 120 is provided so as to oppose a surface of the insulating substrate 102 on a protruding direction side of the tip portion of the ink guide 106. The counter electrode 120 is given a predetermined potential level and holds a recording medium P as a platen.

In addition, in the ink reservoir 114 in the ink jet head 100, an ink circulation mechanism (not shown) is provided which circulates ink Q through an ink supply tube (not shown) and an ink recovery tube (not shown).

It should be noted here that as the ink Q, ink is used in which charged colorant components (charged fine particles) is dispersed in a colloidal or suspended state in an insulating solvent having resistivity of $10^8$ Ω·cm or more and is floated in the solvent.

In the ink jet head 100 having such a construction, the ink Q containing the colorant components moves upward in the ink guide groove 108 by capillary action and is gradually accumulated in the tip portion of the ink guide 106. When a high-voltage pulse is applied from the signal voltage source 112 to the control electrode 110 under this state, an ink droplet containing the colorant components flies out from the ink guide 106, is attracted by the counter electrode 120, and adheres onto the recording medium P. By ejecting multiple ink droplets in this manner, an image is recorded on the recording medium P.

FIG. 4 is a schematic cross-sectional view schematically showing an ink jet head of a conventional ink jet recording apparatus disclosed in JP 10-138494 A.

As shown in FIG. 4, in an ink jet head 130, an insulating support substrate 132 and a substrate 134 are arranged so as to oppose each other. An ink reservoir 136 is formed between the insulating support substrate 132 and the substrate 134. In the ink reservoir 136, an ink supply tank (not shown) is provided through a tube (not shown).

Also, a substrate through hole 132*a* is formed in the insulating support substrate 132. A first control electrode 140 and a second control electrode 142 are respectively formed on the front surface and the back surface of the insulating support substrate 132 so as to surround the periphery of the through hole 132*a*. Further, a metallic platen 120*a* is arranged so as to oppose a front surface side of the insulating support substrate 132. This metallic platen 120*a* doubles as a counter electrode and a recording medium P is held by the metallic platen 120*a*.

In addition, a signal voltage source 144 is connected to the first control electrode 140 and the second control electrode 142, and a bias voltage source 146 is connected between the second control electrode 142 and the metallic platen 120*a* grounded. As the ink Q, conductive ink having conductivity of around $10^5$ to $10^9$ Ω·cm is used.

In the ink jet head 130 having such a construction, the ink Q is supplied from the ink supply tank to the ink reservoir 136, and the ink Q in the ink reservoir 136 is supplied into the through hole 132*a* by means of a hydrostatic pressure. Also, a bias voltage is applied to the first control electrode 140 and the second control electrode 142 by the bias voltage source 146. Under this state, a signal voltage based on an image signal is applied between the first control electrode 140 and the second control electrode 142 by the signal voltage source 144 so as to be superimposed on the bias voltage applied to the first control electrode 140 and the second control electrode 142. As a result, an ink droplet is caused to fly from an ink surface formed in the through hole 132*a*. This flying ink droplet is accelerated by the bias voltage applied to the metallic platen 120*a* as well as the first control electrode 140 and the second control electrode 142 and reaches the recording medium P. By ejecting multiple ink droplets in this manner, an image is formed on the recording medium P.

In the ink jet heads 100 and 130 shown in FIGS. 3 and 4, however, even at the time of ordinary usage, in particular due to influences of apparatus vibrations, ink supply pressure fluctuations, and the like, a phenomenon such as ink seepage, changing of the shape of an ink meniscus formed at each tip of ink guide, or changing of the positional relationship between the meniscus and the tip of ink guide occurs and influences print characteristics. In particular, in the case of a line head and the like where it is required to arrange ink ejection portions at high density, there occurs a problem in that due to interference of ink between adjacent ejection portions, it becomes impossible to control the diameter of each ink droplet, making it difficult to record an image of high quality.

SUMMARY OF THE INVENTION

The present invention has been made in order to solve the problems of the conventional techniques described above and has an object to provide an electrostatic ink jet head with which it becomes possible to fix the edge portion of a meniscus of ink formed on a surface of an insulating substrate in proximity to a through hole, in the through hole, or between these and the periphery of the tip portion of an ink guide for causing a liquid droplet, such as an ink droplet, to be ejected by means of an electrostatic force and to maintain the position and shape of the ink meniscus with stability, thereby allowing ejection/flying of a liquid droplet, such as an ink droplet, with stability and formation of an image of high quality on a liquid droplet reception member such as a recording medium.

In order to attain the above-mentioned object, the present invention provides an electrostatic ink jet head that causes an electrostatic force to act on ink obtained by dispersing particles in a solvent so that liquid droplets containing the particles fly toward a liquid droplet reception member, the electrostatic ink jet head comprising: a head substrate; an insulating substrate which is arranged apart from the head substrate at a predetermined distance and has at least one through hole, wherein an ink passage formed between the insulating substrate and the head substrate; ink supply means for supplying the ink to the ink passage; a control electrode provided to the insulating substrate so as to surround the through hole and applied a first signal in order to control ejection of the liquid droplets; and meniscus control means for controlling fixing of an edge portion of an ink meniscus formed in proximity to the through hole or within the through hole, applied a second signal that is different from the first signal.

It is preferable that the meniscus control means fixes the edge portion of the ink meniscus by increasing at least one of a contact angle of the ink meniscus and viscosity of the ink.

It is preferable that a first voltage of the first signal applied to the control electrode is higher than a second voltage of the second signal applied to the meniscus control means.

It is preferable that the meniscus control means has cooling means for decreasing a temperature of the edge portion of the ink meniscus.

It is preferable that the cooling means is a Peltier element.

It is preferable that the Peltier element is formed so as to surround the through hole on a surface of the insulating substrate on a side opposite to a surface of the insulating substrate opposing the head substrate.

It is preferable that the meniscus control means has a heater for increasing a temperature of the ink.

It is preferable that the meniscus control means is formed on a surface of the insulating substrate on a side opposite to a surface of the insulating substrates opposing the head substrate so as to surround the through hole.

It is preferable that the electrostatic ink jet further comprises an ink guide arranged on the head substrate such that a tip portion of the ink guide is positioned at approximately a center of the through hole and protrudes through the through hole.

As described above, with the electrostatic ink jet head according to the present invention, it becomes possible to fix the edge portion of a meniscus of ink formed on a surface of an insulating substrate in proximity to a through hole, in the through hole, or between these and the periphery of the tip portion of an ink guide for causing a liquid droplet, such as an ink droplet, to be ejected by means of an electrostatic force and to maintain the position and shape of the meniscus with stability, thereby allowing ejection/flying of liquid droplets, such as ink droplets, with stability and formation of an image of high quality on a liquid droplet reception member such as a recording medium.

This application claims priority on Japanese patent application No. 2003-315525, the entire contents of which are hereby incorporated by reference.

DETAILED DESCRIPTION OF THE PREFERRED EMBODIMENT

Hereinafter, the electrostatic ink jet head according to the present invention will be described in detail based on a preferred embodiment illustrated in the accompanying drawings.

Figure 1:
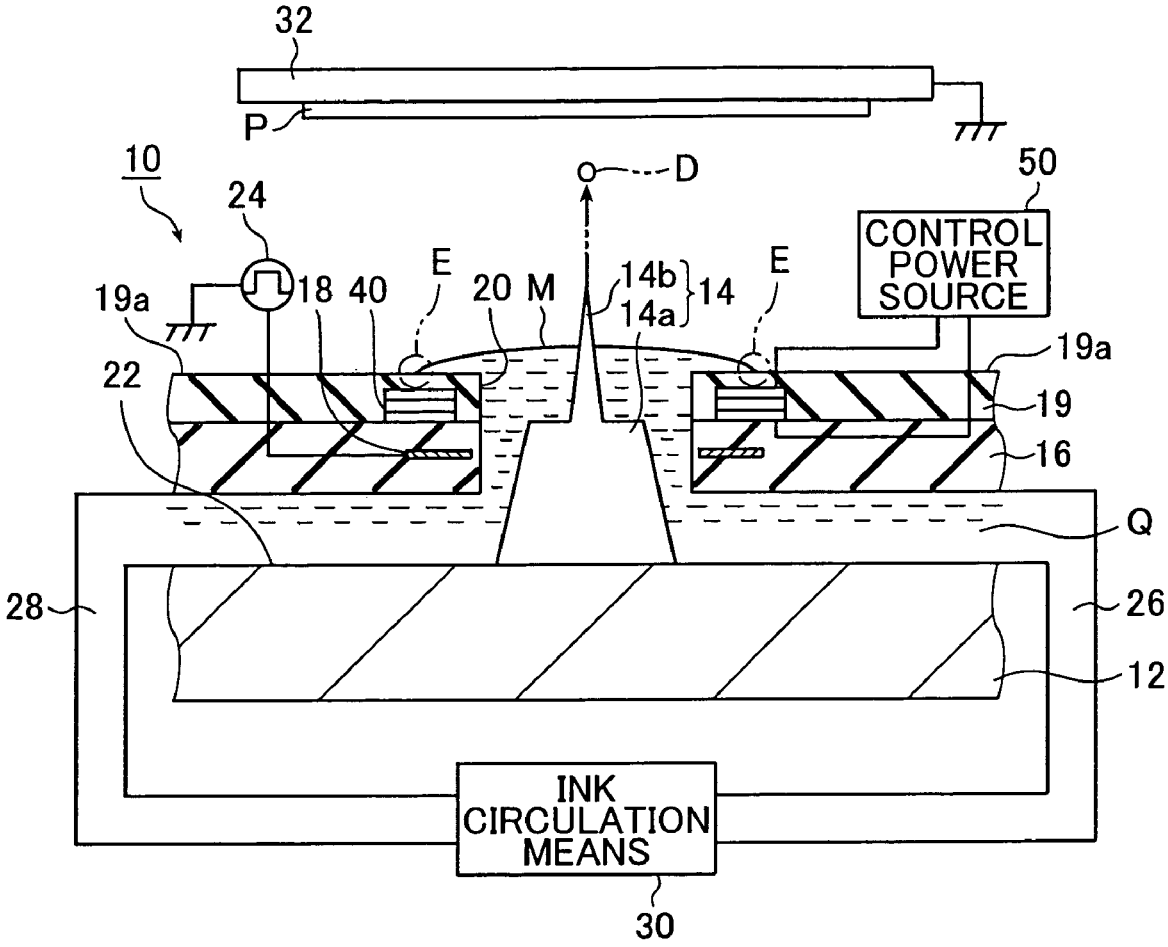
FIG. 1 is a schematic cross-sectional view schematically showing an electrostatic ink jet apparatus provided with an electrostatic ink jet head according to an embodiment of the present invention.

FIG. 1 is a schematic cross-sectional view schematically showing an electrostatic ink jet apparatus provided with an electrostatic ink jet head according to an embodiment of the present invention. Note that in order to simplify the description of the electrostatic ink jet head, only one ejection portion thereof, which has a structure that an ink guide is arranged at the center of a through hole formed in an insulating substrate, is illustrated as shown in FIG. 1 and the following description will be made with reference to this drawing. Needless to say, however, the present invention is not limited to this and the electrostatic ink jet head may include multiple ejection portions.

Referring to FIG. 1, an electrostatic ink jet head (hereinafter referred to as the "ink jet head") 10 in this embodiment causes ink Q containing a colorant components like charged pigments (toner, for instance) to fly as an ink droplet (liquid droplet) D based on image data by means of an electrostatic force. By ejecting multiple ink droplets in this manner, the ink jet head 10 records an image on a recording medium (liquid droplet reception member) P. The ink jet head 10 includes a head substrate 12, an ink guide 14, an insulating substrate 16, a control electrode (first control electrode) 18, an insulation film 19, an ink passage 22, a signal voltage source 24, an ink supply tube 26, an ink recovery tube 28, an ink circulation means 30, a meniscus control means (second control electrode) 40, and a control power source 50. Also, a counter electrode 32 is provided so as to oppose the ink jet head 10.

It should be noted here that in FIG. 1 only one ejection portion, where the ink guide 14 is provided at the center of a through hole 20, of the ink jet head 10 is illustrated. In reality, however, the ink jet head 10 has a multi-channel structure where multiple ejection portions are arranged. Also, the ink jet head 10 is applicable to either of monochrome image recording and color image recording.

The head substrate 12 is a substrate on which the ink guide 14 is formed. Also, the insulating substrate 16 is arranged apart from the head substrate 12 at a predetermined distance so as to oppose the head substrate 12. By the head substrate 12, and the insulating substrate 16, the ink passage 22 for supplying the ink Q to the ink guide 14 is formed.

The ink guide 14 is a guide member for causing the ink Q to be ejected and includes a base portion 14*a* provided on the head substrate 12 and a protrusion-shaped tip portion 14*b* provided on the base portion 14*a*. The base portion 14*a* has a truncated cone shape and the protrusion-shaped tip portion 14*b* has a cone shape, for instance. Also, the ink guide 14 is an insulating member made of plastic resin or ceramics, for instance.

The insulating substrate 16 is made of ceramics, such as $Al_2O_3$ or $ZrO_2$, or a resin such as polyimide. The insulation film 19 is formed on this insulating substrate 16. The through hole 20 is formed in the insulation film 19 and the insulating substrate 16 so as to pass through the insulation film 19 and the insulating substrate 16. This through hole 20 is opened so as to oppose the counter electrode 32. The ink guide 14 is arranged so that the center axis of the protrusion-shaped tip portion 14*b* coincides with the center axis of the through hole 20.

The control electrode 18 is formed in the insulating substrate 16 so as to surround the periphery of the through hole 20. This control electrode 18 has a ring shape. Also, the control electrode 18 is connected to the signal voltage source 24.

The signal voltage source 24 is connected to the control electrode 18 and applies a bias voltage (1.5 kV, for instance) to the control electrode 18. In addition, the signal voltage source 24 applies a pulse voltage (600 V, for instance) to the control electrode 18 as an image signal (first signal) based on image data so as to be superimposed on the bias voltage.

In the ink jet head 10 in this embodiment, by applying an image signal as a pulse voltage from the signal voltage source 24 to the control electrode 18 based on image data, for instance, an ink droplet D is caused to be ejected from the protrusion-shaped tip portion 14*b* of the ink guide 14. The control electrode 18 is made of aluminum so as to have a wiring film thickness of 0.8 μm and a wiring width of 5 μm, for instance. The material of the control electrode 18 is not limited to aluminum and may be aluminum alloy, copper, copper alloy, or the like, for instance.

Also, the insulation film 19 is formed on the insulating substrate 16 so as to cover the meniscus control means 40 formed on the insulating substrate 16. The insulation film 19 is made of resin fluoride, such as Cytop (registered trademark), and is a lamination film of an insulation layer having a thickness of 0.5 μm and an inorganic insulation layer formed on the insulation layer. The inorganic insulation layer is made of $SiO_2$, for instance. In addition, a coat layer made of a silane coupling agent having a fluorine group, with which it is possible to form an adsorption monolayer, is formed on the inorganic insulation layer. This coat layer is not specifically limited and may be instead a layer made of silicone resin or the like having low surface energy, for instance.

The ink circulation means 30 is a means for circulating the ink Q by supplying the ink Q to the ink passage 22 and recovering the ink Q from the ink passage 22, and doubles as an ink supply means. The ink circulation means 30 is connected to the ink supply tube 26 and the ink recovery tube 28 connected to the ink passage 22. This ink circulation means 30 circulates the ink Q in a direction from an ink supply tube 26 side to an ink recovery tube 28 side at a predetermined speed at the time of recording. To do so, the ink circulation means 30 includes a pump, an ink tank, and the like, although these construction elements are not shown in the drawing. The ink Q sent out from the ink circulation means 30 is supplied to the ink passage 22 through the ink supply tube 26, a part of the ink Q is ejected from the ink guide 14, and the remaining part of the ink Q is recovered to the ink circulation means 30 from the ink passage 22 through the ink recovery tube 28.

The meniscus control means 40 locally cools the ink Q, thereby increasing the viscosity and surface tension of the ink Q in the cooled portion. As a result, an edge portion E of a meniscus M formed on a surface 19*a* of the insulation film 19 by the ink Q overflowed from the through hole 20 is fixed in a predetermined area on the surface 19*a* of the insulation film 19 and the shape of the meniscus M is stabilized. This meniscus control means is controlled by a control signal (second signal) that is different from the image signal applied to the control electrode 18.

It should be noted here that in this embodiment, the edge portion E of the meniscus M is fixed on the surface 19*a* of the insulation film 19, although the present invention is not limited to this. For instance, the edge portion E of the meniscus M may be fixed in the through hole 20.

Next, as an example of the meniscus control means 40 in this embodiment, a cooling means will be described which uses a Peltier element among various thermoelectric elements.

Figure 2A:
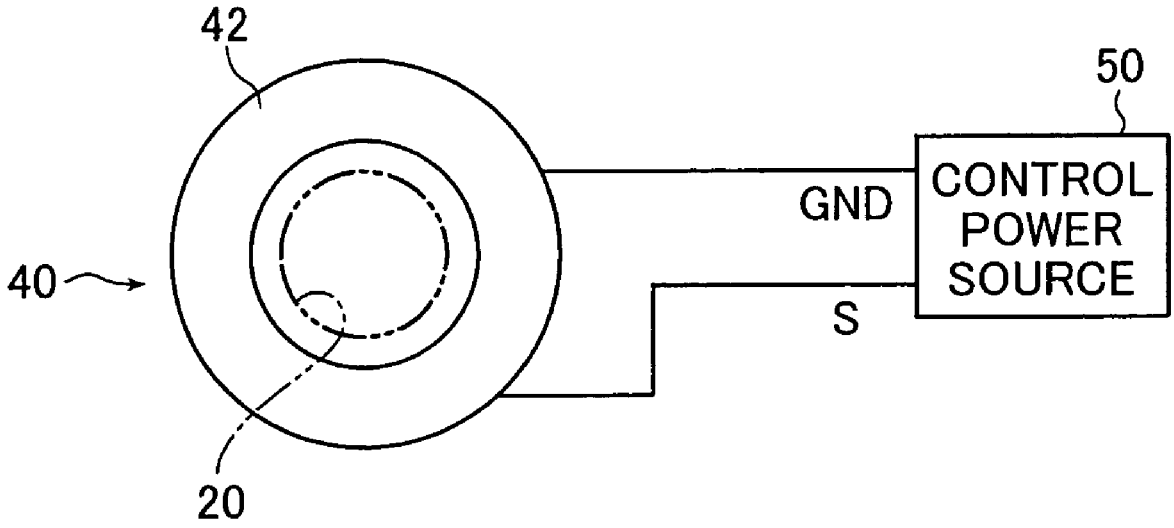
FIG. 2A is a schematic plan view showing a construction of a meniscus control means possessed by the electrostatic ink jet head according to the embodiment.
Figure 2B:
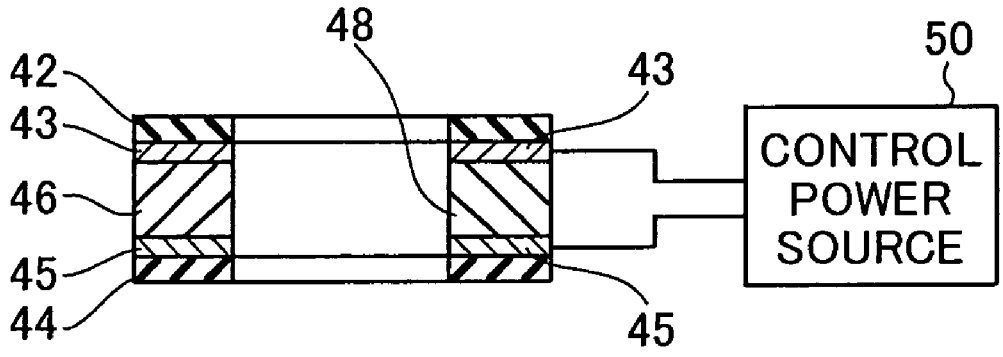
FIG. 2B is a schematic cross-sectional view of the meniscus control means shown in FIG. 2A.
Figure 3:
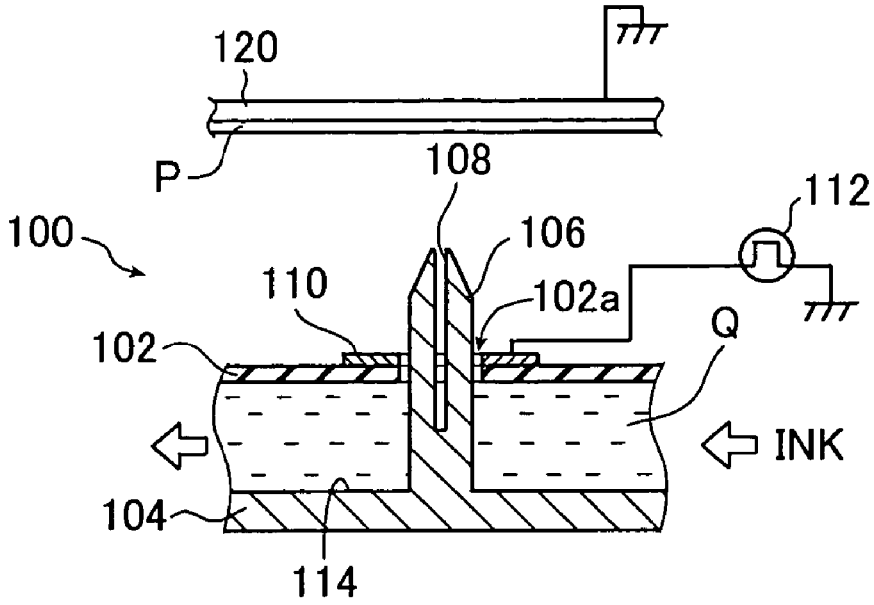
FIG. 3 is a schematic cross-sectional view schematically showing an ink jet head of a conventional ink jet recording apparatus.

FIG. 2A is a schematic plan view showing a construction of the meniscus control means possessed by the electrostatic ink jet head in this embodiment, while FIG. 2B is a schematic cross-sectional view of the meniscus control means shown in FIG. 2A.

As shown in FIG. 2A, the meniscus control means 40 has a ring shape, for instance. Also, as shown in FIG. 2B, the meniscus control means 40 includes an upper substrate 42, an upper electrode 43, a lower substrate 44, a lower electrode 45, p-type thermoelectric elements 46 having a rectangular parallelepiped shape, and n-type thermoelectric elements 48 having a rectangular parallelepiped shape. Further, the meniscus control means 40 is controlled by the control power source 50.

In the meniscus control means 40, the p-type thermoelectric elements 46 and the n-type thermoelectric elements 48 are alternately arranged in a circular shape so that their long sides extend vertically. Also, each p-type thermoelectric element 46 is connected in series with its adjacent n-type thermoelectric elements 48 by the upper electrode 43 and the lower electrode 45, thereby achieving a construction where all of the p-type thermoelectric elements 46 and all of the n-type thermoelectric elements 48 are connected in series. The ring-shaped upper substrate 42 is provided on the upper surface of the upper electrode 43 and the ring-shaped lower substrate 44 is provided on the lower surface of the lower electrode 45. The control power source 50 is connected to the upper electrode 43 and the lower electrode 45.

The control power source 50 generates a predetermined voltage (second signal) S and applies it to the upper electrode 43 and the lower electrode 45. As a result, a current is passed through the p-type thermoelectric elements 46 and the n-type thermoelectric elements 48 and the surface 19*a* of the insulation film 19 is cooled.

The voltage S applied by the control power source 50 is lower than the pulse voltage applied to the control electrode 18.

It should be noted here that in this embodiment, a means using a Peltier element among various thermoelectric elements has been described as an example of the cooling means, although the present invention is not limited to this. That is, the thermoelectric element constituting the cooling means is not specifically limited so long as it is possible to cool the ink Q.

In the meniscus control means 40 in this embodiment, by applying the predetermined voltage S from the control power source 50, the upper substrate 42 is cooled and heat deprived by the cooling of the upper substrate 42 is dissipated from the lower substrate 44. Therefore, it becomes possible to reduce the temperature of the surface 19*a* of the insulation film 19 in an area corresponding to the meniscus control means 40. As a result, the viscosity and surface tension of the ink Q are increased and the edge portion E of the meniscus M is fixed on the surface 19*a* of the insulation film 19 in an area above the meniscus control means 40.

It should be noted here that in the case of a coating layer made of fluororesin or the like, its contact angle with ink, whose main ingredient is an insulating solvent, becomes small and it becomes impossible to fix the edge portion of the meniscus. With the meniscus control means 40 in this embodiment, however, by locally increasing the viscosity and surface tension of the ink Q through the cooling of the ink Q, it becomes possible to fix the edge portion E of the meniscus M even in the case of ink whose main ingredient is an insulating solvent. Therefore, it becomes possible to maintain the shape of the meniscus M constant. In particular, it is preferable that an isoparaffin-based solvent is used as the insulating solvent of the ink Q, because in this case the viscosity and surface tension of the ink Q are increased through the cooling of the ink Q and therefore it becomes possible to fix the edge portion E of the meniscus M and to stabilize the shape of the meniscus M.

Also, in this embodiment, the installation place of the meniscus control means 40 is not specifically limited and it is sufficient that the meniscus control means 40 is provided in a place that enables cooling of an area of the surface 19*a* of the insulation film 19 in proximity to the through hole 20, in the through hole 20, or the like in which the edge portion E of the meniscus M should be fixed.

It should be noted here that the ink Q used in this embodiment is, for instance, ink in which a positively charged colorant components (hereinafter also referred to as the "charged fine particles") is dispersed in a colloidal or suspended state in an insulating solvent together with a charge control agent, a binder, and the like and is floated in the solvent. Here, it is assumed that the voltage applied to the control electrode 18 has the same polarity as the charged fine particles. Also, it is preferable that the insulating solvent has resistivity of $10^8$ Ω·cm or more.

Also, in this embodiment, it is preferable that a metallic thin film is formed on the protrusion-shaped tip portion 14*b* of the ink guide 14. With this metallic thin film, it becomes possible to lower the level of a strong electric field required to cause the ink droplet D to fly and therefore it becomes possible to lower the voltage level of the pulse voltage or the bias voltage that needs to be applied to the control electrode 18.

Also, the shape of the ink guide 14 is not specifically limited so long as it is possible to cause the ink Q, in particular, the charged fine particles in the ink Q to pass through the through hole 20 in the insulating substrate 16 and to be concentrated in the protrusion-shaped tip portion 14*b*. For instance, the protrusion-shaped tip portion 14*b* of the ink guide 14 is not limited to the protrusion shape and may be changed as appropriate to the shape of the conventionally known ink guide disclosed in JP 10-230608 A described above or the like.

The counter electrode 32 is arranged at a position opposing the protrusion-shaped tip portion 14*b* of the ink guide 14 and is grounded. Also, the counter electrode 32 doubles as a platen of the recording medium P and the recording medium P is supported on a surface of the counter electrode 32 on an ink jet head 10 side.

Next, an operation of the ink jet head 10 in this embodiment will be described.

In the ink jet head 10 shown in FIG. 1, at the time of recording, the ink Q containing the positively (+) charged colorant components (charged fine particles) is caused by the ink circulation means 30 to move in the ink passage 22 from the ink supply tube 26 to the ink recovery tube 28, for instance. The voltage applied by the control electrode 18 has the same polarity as the charged fine particles in the ink Q. At this time, the recording medium P is electrostatically adsorbed on the counter electrode 32.

Here, when no pulse voltage is applied to the control electrode 18 or when the pulse voltage applied to the control electrode 18 is set at a low voltage level (0 V), a voltage (potential difference) between the control electrode 18 and the counter electrode 32 (recording medium P) becomes equal to the bias voltage (1.5 kV, for instance). Consequently, the electric field strength in proximity to the protrusion-shaped tip portion 14*b* of the ink guide 14 becomes low and the ink Q will not be ejected from the protrusion-shaped tip portion 14*b* of the ink guide 14 as the ink droplet D.

Under this state, however, a part of the ink Q in the ink passage 22, in particular, the charged fine particles contained in the ink Q move upward toward the recording medium P along the ink guide 14 while passing through the through hole 20 in the insulating substrate 16 by migration action, capillary action, or the like and the ink Q overflows from the through hole 20. As a result, the ink meniscus M is formed in proximity to the protrusion-shaped tip portion 14*b* so that the edge portion E of the meniscus M reaches the surface 19*a* of the insulation film 19. Through this formation of the ink meniscus M in proximity to the protrusion-shaped tip portion 14*b*, the ink Q is supplied to the protrusion-shaped tip portion 14*b*.

On the other hand, when a pulse voltage (600 V, for instance) is applied to the control electrode 18 as an image signal based on image data, a voltage (600 V, for instance) that is equal to the applied pulse voltage is superimposed on the bias voltage (1.5 kV, for instance). Therefore, the voltage (potential difference) between the control electrode 18 and the counter electrode 32 (recording medium P) is increased to 2.1 kV and the electric field strength in proximity to the protrusion-shaped tip portion 14*b* of the ink guide 14 is increased.

Under this state, the ink Q, in particular, the charged fine particles concentrated in the ink Q, which moved upward along the ink guide 14 and reached the protrusion-shaped tip portion 14*b* are ejected from the protrusion-shaped tip portion 14*b* of the ink guide 14 toward the counter electrode 32 (recording medium P) as the ink droplet D containing the charged fine particles by means of an electrostatic force, and adhere onto the recording medium P.

That is, in this embodiment, a voltage (1.5 kV, for instance) is constantly given from the signal voltage source 24 to the control electrode 18 as a bias voltage. Also, an image signal corresponding to image data from the signal voltage source 24, for instance a pulse voltage of 600 V as a control voltage, is applied to the control electrode 18 to be superimposed on the bias voltage. That is, when the control voltage is at 0 V (OFF state) and the voltage of the control electrode 18 is at 1.5 kV, the ink droplet D of the ink Q will not fly. On the other hand, when the control voltage becomes 600 V (ON state) and the voltage of the control electrode 18 becomes 2.1 kV, the ink droplet D having a predetermined size flies from the protrusion-shaped tip portion 14*b* of the ink guide 14. The filed ink droplet D is attracted toward the counter electrode 32 by an electric field generated between the control electrode 18 and the counter electrode 32 and impinges on the recording medium P at a predetermined position. By ejecting multiple ink droplets in this manner, an image is recorded on the recording medium P.

In this embodiment, the meniscus control means 40 is provided so as to correspond to an area where the edge portion E of the meniscus M should be fixed. When a voltage is applied to the meniscus control means 40, the surface 19*a* of the insulation film 19 is locally cooled, so that the temperature of the ink Q overflowed onto the surface 19*a* is reduced and the surface tension of the ink Q is increased in the cooled area of the surface 19*a*. Consequently, the contact angle of the ink Q existing above the meniscus control means 40 is increased and the edge portion E of the meniscus M is fixed in the area of the surface 19*a* of the insulation film 19 corresponding to the meniscus control means 40.

As described above, in this embodiment, by fixing the meniscus M in a predetermined area using the meniscus control means 40, the shape of the meniscus M is stabilized. Therefore, the flying direction of the ink droplet D also becomes constant and the impingement position of the ink droplet D is determined so as to correspond to the (enter of the protrusion-shaped tip portion 14*b* of the ink guide 14. As a result, it becomes possible to cause the ink droplet D to impinge on the recording medium P at a correct position and to record an image of high quality on the recording medium P. Also, the shape of the meniscus M is stabilized, so that it becomes possible to cause the ink droplet D having a predetermined size (predetermined amount) to be ejected with reliability and to record a favorable image having a stabilized density on the recording medium P.

Further, the meniscus M is fixed in the predetermined area, so that integration of the ink in a certain through hole and the ink in other adjacent through holes (not shown) is prevented, so that inter-channel interference will never occur. As a result of the prevention of the inter-channel interference, it becomes possible to prevent disturbances in the ejection directions of ink droplets and disturbances in the ejection frequencies of the ink droplets due to cross-linking of ink.

It should be noted here that in this embodiment, the cooling means including the p-type thermoelectric elements and the n-type thermoelectric elements has been described as an example of the meniscus control means 40 and the viscosity and surface tension of the ink Q are increased by cooling the ink Q using the cooling means. However, the present invention is not limited to this and another meniscus control means may be used so long as it is possible to fix the edge portion of the meniscus by increasing at least the contact angle of the meniscus or the viscosity of the ink.

If the ink Q is ink whose surface tension is increased or whose contact angle in the edge portion of the meniscus is increased through heating, for instance, the meniscus control means may be a means having a heating element (heater). Also, if the ink Q is ink whose surface tension is increased or whose contact angle in the edge portion of the meniscus is increased through application of an electric field, the meniscus control means may be a means that is capable of applying an electric field to the meniscus M. Note that even with the meniscus control means 40 in the above embodiment that uses the thermoelectric elements, it is possible to heat the upper substrate 42 and to heat the surface 19*a* of the insulation layer 19 by changing the polarity of the applied voltage.

Figure 4:
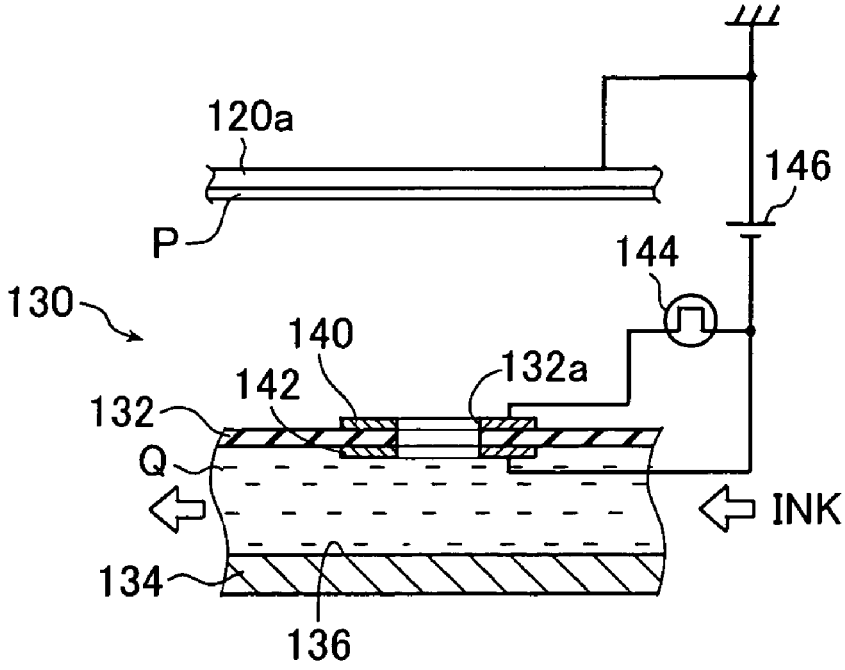
FIG. 4 is a schematic cross-sectional view schematically showing an ink jet head of another conventional ink jet recording apparatus.

Also, in the above embodiment, the ink guide 14 is provided, although this ink guide 14 is not an indispensable construction element. That is, there occurs no problem even if the electrostatic ink jet head according to the present invention is not provided with the ink guide 14 like in the case shown in FIG. 4.

Further, in the above embodiment, the electrostatic ink jet head is applied to ejection of the ink containing the charged colorant components, although the present invention is not specifically limited to this so long as the ink jet head is used as a liquid ejection head that causes a liquid containing charged particles to be ejected. For instance, the electrostatic ink jet head may be applied to an application apparatus that uses a liquid containing charged particles made of polyimide and performs liquid application by ejecting liquid droplets containing the charged particles.

The electrostatic ink jet head according to the present invention has been described in detail above, although the present invention is not limited to the above description and it is of course possible to make various modifications and changes without departing from the gist of the present invention.

What is claimed is:

1. An electrostatic ink jet head that causes an electrostatic force to act on ink obtained by dispersing particles in a solvent so that liquid droplets containing said particles fly toward a liquid droplet reception member, said electrostatic ink jet head comprising:

a head substrate;

an insulating substrate which is arranged apart from said head substrate at a predetermined distance and has at least one through hole, wherein an ink passage is formed between said insulating substrate and said head substrate;

ink supply means for supplying said ink to said ink passage;

a control electrode provided to said insulating substrate so as to surround said through hole and applied a first signal in order to control ejection of said liquid droplets; and meniscus control means for controlling fixing of an edge portion of an ink meniscus formed in proximity to said through hole or within said through hole, applied a second signal that is different from said first signal, wherein said meniscus control means fixes the edge portion of said ink meniscus by increasing at least one of a contact angle of said ink meniscus and viscosity of said ink.

2. The electrostatic ink jet head according to claim 1, wherein a first voltage of the first signal applied to said control electrode is higher than a second voltage of said second signal applied to said meniscus control means.

3. The electrostatic ink jet head according to claim 1, wherein said meniscus control means has cooling means for decreasing a temperature of said edge portion of said ink meniscus.

4. The electrostatic ink jet head according to claim 3, wherein said cooling means is a Peltier element.

5. The electrostatic ink jet head according to claim 4, wherein said Peltier element is formed so as to surround said through hole on a surface of said insulating substrate on a side opposite to a surface of said insulating substrate opposing said head substrate.

6. The electrostatic ink jet head according to claim 1, wherein said meniscus control means has a heater for increasing a temperature of said ink.

7. The electrostatic ink jet head according to claim 1, wherein said meniscus control means is formed on a surface of said insulating substrate on a side opposite to a surface of said insulating substrate opposing said head substrate so as to surround said through hole.

8. The electrostatic ink jet head according to claim 1, further comprising an ink guide arranged on said head substrate such that a tip portion of said ink guide is positioned at approximately a center of said through hole and protrudes through said through hole.

9. The electrostatic ink jet head according to claim 1, wherein said control electrode is provided in said insulating substrate and said meniscus control means is provided in a predetermined position on a surface of said insulating substrate on a side opposite to a surface of said insulating substrates opposing said head substrate so as to surround said through hole and for controlling fixing a position of said edge portion of said ink meniscus formed in proximity to said through hole or within said through hole to said predetermined position, by applying said second signal that is different from said first signal to increase surface tension of said ink locally in proximity to said through hole or within said through hole.

10. The electrostatic ink jet head according to claim 1, wherein said control electrode is applied said first signal in order to control ejection of said liquid droplets according to said image signal and said meniscus control means is applied said second signal that is different from said first signal but does not vary according to said image signal.

* * * * *